United States Patent [19]

Cook, Jr.

[11] 4,358,868

[45] Nov. 16, 1982

[54] HIGH SPEED FLOOR POLISHER

[75] Inventor: Floyd L. Cook, Jr., Muskegon Heights, Mich.

[73] Assignee: McGraw-Edison Company, Rolling Meadows, Ill.

[21] Appl. No.: 149,004

[22] Filed: May 12, 1980

[51] Int. Cl.[3] ..... A47L 11/162

[52] U.S. Cl. ..... 15/49 R; 51/177

[58] Field of Search ..... 15/49 R, 50 R, 98, 385, 15/50 C, 40 C; 51/177

[56] References Cited

U.S. PATENT DOCUMENTS

| | | | |
|---|---|---|---|
| 1,434,109 | 10/1922 | Finnell . | |
| 1,554,622 | 9/1925 | Chancellor | 15/49 R |
| 1,601,087 | 9/1926 | Simpson | 15/49 R |
| 1,626,742 | 5/1927 | Lockwood | 15/98 |
| 1,829,132 | 10/1931 | Finnell . | |
| 1,878,508 | 9/1932 | Menkhaus . | |
| 1,958,077 | 5/1934 | Vinella | 51/177 |
| 2,079,946 | 5/1937 | Myers . | |
| 2,541,812 | 2/1951 | Finnell | 15/50 R |
| 2,565,658 | 8/1951 | Hilger . | |
| 2,600,233 | 6/1952 | Finnell . | |
| 2,618,798 | 11/1952 | Ohrt . | |
| 2,684,495 | 7/1954 | Litkenhous | 15/98 X |
| 2,949,619 | 8/1960 | Holt | 15/49 R |
| 3,124,911 | 3/1964 | Vinella . | |
| 3,264,674 | 8/1966 | Doyle, Jr. et al. . | |
| 3,422,579 | 1/1969 | Rogge et al. . | |
| 3,715,772 | 2/1973 | Downing et al. . | |
| 3,921,244 | 11/1975 | Warren et al. . | |
| 4,099,328 | 7/1978 | Schlemmer | 15/49 R |
| 4,115,890 | 9/1978 | Burgoon | 15/49 R |
| 4,122,576 | 10/1978 | Bevington et al. . | |

FOREIGN PATENT DOCUMENTS

| | | | |
|---|---|---|---|
| 2709193 | 9/1978 | Fed. Rep. of Germany | 15/49 R |

*Primary Examiner*—Edward L. Roberts

*Attorney, Agent, or Firm*—Thomas M. McKinley; Jon Carl Gealow; Hugh M. Gilroy

[57] ABSTRACT

A high speed vertical axis floor treating machine for polishing, brushing or scrubbing a floor includes a frame, a drive motor on the frame for rotating a floor treating element, a control handle pivoted to the frame, and a pair of ground engaging wheels mounted on an axle. The frame is resiliently supported on the axle to permit edging of the floor treating element. An adjustment rod engaging the axle raises and lowers the frame on the axle. The drive motor is mounted rearwardly of the axle to counterbalance the weight of the floor treating element about the axle.

16 Claims, 6 Drawing Figures

HIGH SPEED FLOOR POLISHER

BACKGROUND OF THE INVENTION

The present invention relates to floor machines and more particularly to vertical axis, rotary floor treating machines.

Heretofore, a wide variety of vertical axis floor treating machines have been proposed for brushing, scrubbing and/or polishing a floor surface. Such machines typically include a frame, a pivotable operator's control handle and a generally circular floor treating element driven by an electric motor. The floor treating element is rotated about a central, vertical axis and may take the form of a brush or a polishing pad, for example.

Relatively low speed vertical axis machines typically mount the motor centrally of the floor treating element. The element is then evenly pressed onto the floor surface by the weight of the machine. The machine is moved in a sweeping arc by application of pressure on the control handle. Low speed machines typically operate in the 300 to 400 RPM range. An example of one such floor treating machine may be found in U.S. Pat. No. 3,264,674, entitled FLOOR TREATING MACHINES and issued Aug. 9, 1966, to D. I. Doyle, Jr. et al.

High speed vertical axis floor treating machines operate at speeds in excess of 1000 RPM. Such machines are significantly more effective than more conventional, low speed machines. The weight of the machine, however, cannot be supported entirely on the brush or pad since current draw or power requirements would become excessive. The machines, also, would be extremely difficult to control. As a result, high speed vertical axis machines typically include a pair of ground engaging wheels to help support the machine. Examples of high speed vertical axis machines may be found in U.S. Pat. No. 4,115,890, entitled HIGH-SPEED POLISHING MACHINE and issued on Sept. 26, 1978, to Burgoon and U.S. Pat. No. 4,122,576, entitled HIGH-SPEED FLOOR TREATING MACHINE and issued on Oct. 31, 1978, to Bevington et al.

Problems have been experienced with ease of operation and control of the brush or pad aggressiveness of the high speed machines. Also, problems have been experienced with maintaining proper contact of the high speed pad or brush when different thickness pads are substituted. Such substitution requires adjustment of the wheel height of the machine. Further, prior machines have not permitted effective and efficient edge control. Heretofore, in order to increase the pressure along one side of the pad when "edging" the machine, it was necessary to reef the whole machine over and balance it on one wheel. Such an operating mode can present a danger to the operator due to loss of control of the machine.

SUMMARY OF THE INVENTION

In accordance with the present inventon, a unique vertical axis floor treating machine is provided whereby the problems heretofore experienced are substantially eliminated. Essentially, the machine includes a main frame and a pair of ground engaging wheels rotatably mounted on a transversely positioned axle. Suspension means carried by the frame and engaging the axle supports the frame on the axle and permits pivoting or rotational movement about a longitudinal axis of the frame when edging is desired. The suspension means normally maintains the frame in a generally horizontal position.

In other aspects of the invention, height adjustment means are provided for easily adjusting the height of the frame with respect to the ground engaging wheels. This permits quick adjustment of the machine to maintain different pads or brushes essentially horizontal to the floor.

In further aspects of the invention, a control handle is pivoted to the frame in a position generally above the axle of the ground engaging wheels and an electric motor drive is supported on the frame rearwardly of the axles and rearwardly of the handle pivot point. The motor, therefore, counterbalances the weight of the pad and drive subassembly and increase the ease by which the machine may be controlled by the operator.

DETAILED DESCRIPTION OF THE PREFERRED EMBODIMENT

Figures 1, 2:
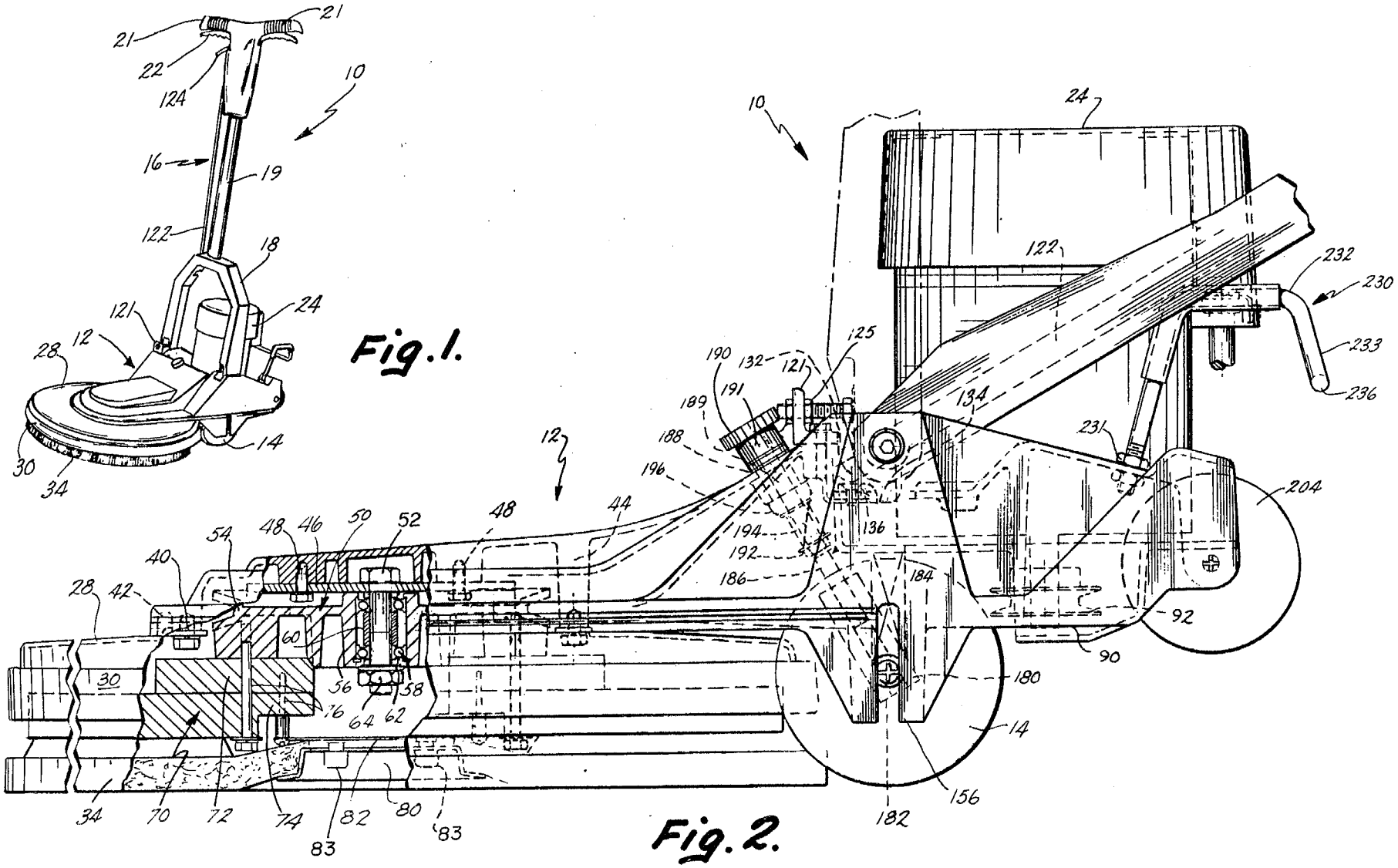
FIG. 1 is a perspective view of a unique vertical axis floor treating machine in accordance with the present invention.
FIG. 2 is a fragmentary, partially sectioned, side elevational view of the machine.

With reference to the drawings, a high speed, vertical axis floor treating machine in accordance with the preferred embodiment of the invention is illustrated and generally designated 10. As seen in FIG. 1, the machine includes a main frame 12 supported by ground engaging wheels 14 and a control handle 16 having a lower yoke 18 pivoted to the main frame. Control handle 16 includes an elongated tubular portion 19 joining an upper portion 20 to yoke 18. Portion 20 defines operator handle grips 21. Switch levers 22 are pivoted to portion 20. Supported on the main frame 12 rearwardly of the point where yoke 18 pivots to the frame is an electric drive motor 24. Secured to the forward portion of main frame 12 is a generally circular shield or housing 28. A peripheral bumper pad 30 is secured to shield 28. As explained below, drive motor 24 is operatively connected to and rotates a brush or pad 34 rotatably mounted on the frame 12.

As best seen in FIG. 2, main frame 12 is preferably a cast metal member. Housing 28 is secured thereto by suitable fasteners, such as bolts 40, to mounting points or bosses 42, 44 defined by the frame 12. A support plate 46 is bolted to the under surface of main frame 12 at four equally spaced points by fasteners 48. A driven pulley or sheeve 50 is rotatably mounted to plate 46 by an elongated bolt or shaft 52 extending through an aperture 53 formed centrally in plate 46. Driven pulley 50 includes a circumferential, belt receiving groove 54 and a central hub 56. Bolt 52 extends through hub 56 and has positioned thereon a pair of vertically spaced bearing assemblies 58. Bearing assemblies 58 are preferably ball bearing structures positioned by a central spacer 60.

The lower end of bolt 52 receives a support washer 62 and a nut 64. Bolt 52 and bearing assemblies 58 rotatably mount the drive pulley 50 to plate 46.

A floor treating element driver subassembly 70 including a pair of generally circular members 72, 74 is bolted or otherwise suitably secured to the driven sheeve or pulley 50 by suitable fasteners 76.

Vertical axis floor treating element 34, illustrated in FIG. 2, is a polishing pad which is secured to the pad driver subassembly 70 by a generally circular, cup-shaped holder 80. Holder 80 is secured by suitable fasteners 83 to a plate 82. It is preferred that fasteners 83 be hand manipulatable twist fasteners. Plate 82 is fastened to driver subassembly member 74. Member 74 engages and drives the pad 34 and includes a plurality of bristle-like elements which dig into pad 34. When a brush is used, member 74 is removed from member 72 by removal of fasteners 76.

Figure 3:
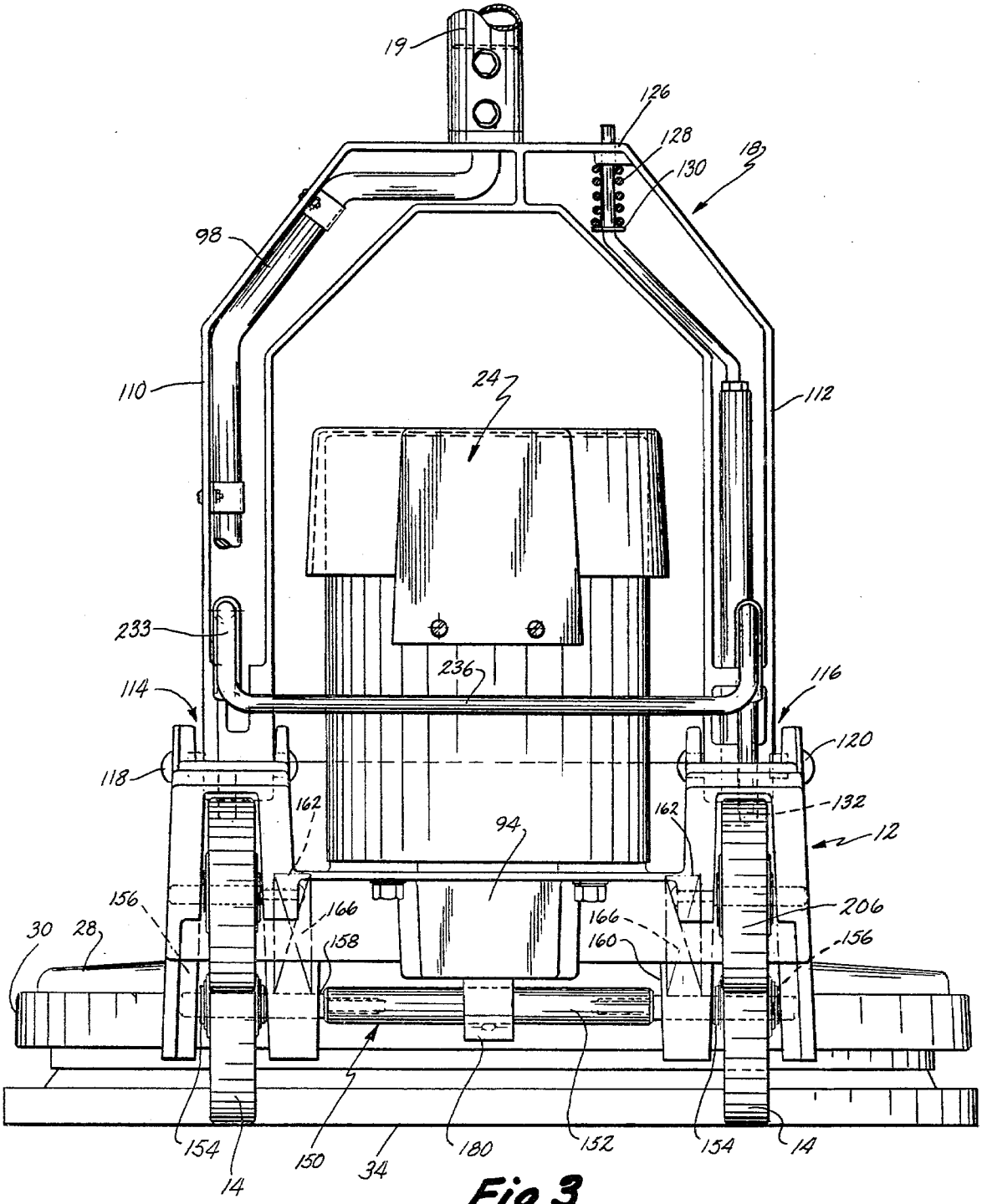
FIG. 3 is a fragmentary, rear elevational view of the machine.
Figure 4:
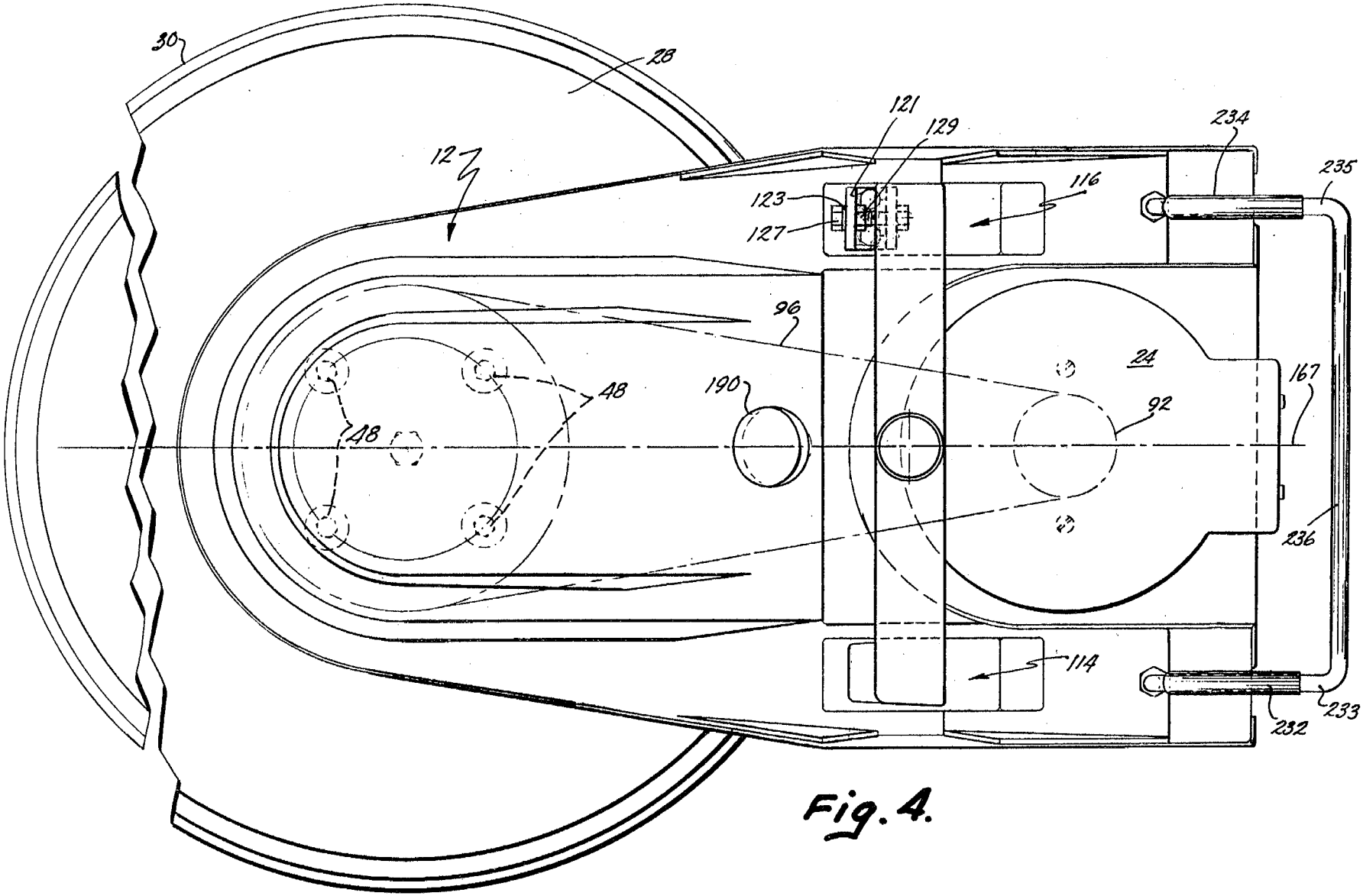
FIG. 4 is a top, plan view of the machine with the control handle removed.

Electric drive motor 24 is bolted or otherwise secured to main frame 12 at the extreme rear of frame 12. Motor 24 includes an output shaft 90 to which is nonrotatably secured a drive pulley 92. As best seen in FIG. 3, output shaft 90 and pulley 92 are enclosed by a suitable cover 94 bolted to the under surface of main frame 12. A suitable V-belt 96, schematically illustrated in FIG. 4, is reeved around drive pulley 92 and driven pulley or sheeve assembley 50. Electric motor 24 is connected to a suitable source of power through a power cord 98 (FIG. 3).

Switch levers 22, which actuate motor 24, are preferably spring biased to an off position so that the motor may be actuated only when the operator grasps the control grips 21. Further, it is preferred that the electrical switch disposed within upper handle portion 20 (not shown) be such that switch levers 22 will not actuated drive motor 24 when the handle 16 is in a vertical, stored or nonoperating position, as illustrated in FIG. 1. Various structures could be employed for such an "interlock" and, for example, could take the form of a small ball positioned in the handle so as to block actuation of levers 22 when the handle is in the upright position but which rolls out of the way to permit levers 22 to be actuated when the handle is pivoted to a second, operating position, as partially illustrated in FIG. 2.

As best seen in FIGS. 1, 2 and 3, yoke portion 18 of handle 16 includes a pair of depending legs 110, 112. Legs 110, 112 are received within suitable recesses 114, 116 defined by main frame 12. As seen in FIG. 3, pivot pins 118, 120 pivotally secure legs 110, 112, respectively, to the main frame.

Control handle 16 is latched in a vertical inoperative position by a latch mechanism including an elongated rod 122. Rod 122 is pivotally secured at its upper end to a latch release lever 124. Lever 124 is pivoted to upper handle portion 20 (FIG. 1). Rod 122 extends downwardly adjacent a central portion of the control handle and through an aperture 126 formed in the channel-shaped yoke 18. Rod 112 is configured to move downwardly along leg portion 122. Rod 122 is biased towards a latched position by a coil spring 128. Spring 128 engages yoke 18 and a washer 130 fixed to the rod (FIG. 3). A lower end 132 of rod 122 (FIG. 2) latches handle 16 in a vertical position when it extends through a latch aperture 134 defined by the upper surface of the main frame 12. In the preferred embodiment, a latch striker plate 136 is secured to the frame immediately adjacent aperture 134.

As best seen in FIGS. 2 and 4, a generally L-shaped bracket 121 is secured to an upper surface of main frame 12 immediately in front of the pivot point for yoke leg 112. Bracket 121 defines a central aperture 123 through which an adjustable stop bolt 125 extends. Bolt 125 is held in an adjusted position by a pair of lock nuts 127, 129 threaded to bolt 125 at the front and rear of bracket 121. Bolt 125 provides a suitable means for adjusting the forward tilt limits of control handle 16.

Figure 5:
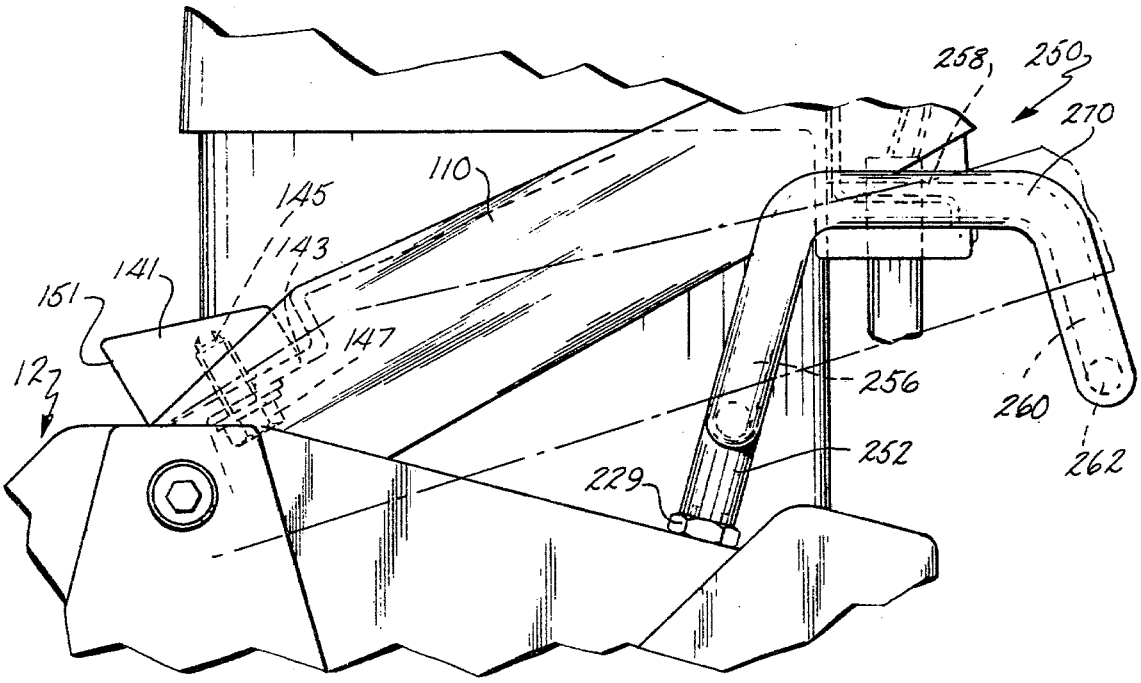
FIG. 5 is a fragmentary, side elevational view showing an alternative yoke stop and power cord storage bracket.
Figure 6:
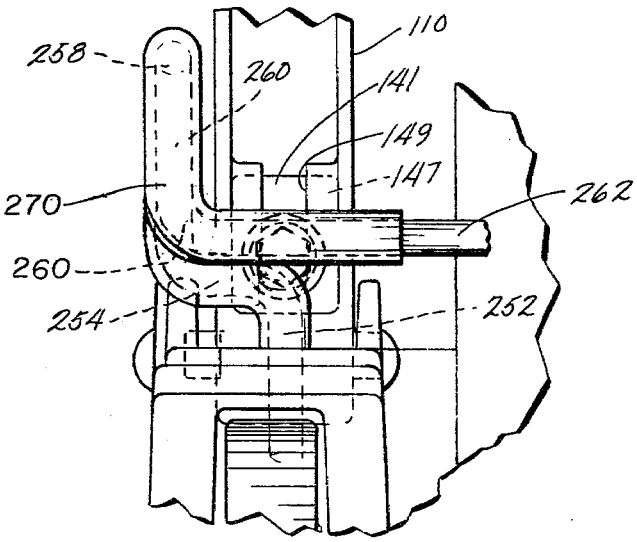
FIG. 6 is a fragmentary, rear elevational view showing the alternative stop and bracket.

An alternative and presently preferred yoke stop is illustrated in FIGS. 5 and 6. The alternative includes a generally rectangular block 141 secured to a lower front cavity surface 143 of yoke leg 110. Block 141 defines a threaded bore 145 into which a bolt 147 extends. Bolt 147 also passes through a guide slot 149 defined by leg 110. Block 141 may be slidably adjusted within cavity 143 by bolt 147. Block 141 has a lower, planar surface 151 which engages the upper surface of the frame in front of the yoke pivot point to limit forward pivotal movement of the handle.

The vertical, inoperative position of the control handle is illustrated in phantom in FIG. 2. In use, the operator pivots latch release lever 124 upwardly, thereby moving latch rod 122 out of aperture 134 against the bias of spring 128. Handle 16 may then be pivoted downwardly to the operating position. When released, handle 16 freely pivots about pins 118, 120.

As best seen in FIGS. 2 and 3, ground engaging wheels 14 are rotatably supported on an axle subassembly 150. Axle subassembly 150 includes a central axle member 152 and a pair of stub shafts 154. Wheels 14 are rotatably supported on stub shafts 154. Housing 28 defines a generally vertically extending, opposed, guide slots or grooves 156 within which the ends of stub shafts 154 ride. Also, as best seen in FIG. 3, frame 12 defines a pair of depending, leg-like structures 158, 160, each of which defines a central bore 162. Each leg-like structure also defines a vertically disposed guide slot in line with slots 156 and which extend past stub shafts 154.

Disposed within bores 162 of each leg is a coil spring 166. Each coil spring 166 engages an upper closed end of its respective bore 162 and a shaft 154 of the axle subassembly. Coil springs 166 in combination with the guide slots or grooves defined by the frame suspend the frame 12 on the axle subassembly 150. Springs 166 bias the frame to a generally horizontal position with respect to the floor surface. In other words, the frame is maintained in a plane generally parallel to a plane passing horizontally through the axle subassembly.

The suspension permits the operator to tilt, pivot or rotate main frame 12 and hence the vertical floor treating element about a longitudinal or roll axis 167 (FIG. 4) of the frame. As seen in FIGS. 3 and 4, the machine is generally symmetrical about the longitudinal axis of the frame 12. In normal use, the weight of the machine is substantially supported by the ground engaging wheels 14 and the suspension subassembly. The operator can easily edge with the machine merely by applying pressure to one side of the control handle to tilt the machine against the bias of the springs 166. The ground engaging wheels remain in contact at all times with the floor. Control of the machine is easily maintained. Springs 166, also, are capable of absorbing shock loading or momentary impacts to ground engaging wheels 14 which might occur during use of the machine.

During operation of a high speed floor polisher of the type illustrated in the drawings, it is necessary to maintain the vertical axis floor treating element 34 in a position essentially horizontal with the floor surface. As different thickness pads or brushes are substituted, the positioning of frame 12 with respect to the ground engaging wheels 14 and hence the floor surface must be varied to maintain a parallel relationship. In accordance with the present invention, a simple, efficient and effective height adjustment mechanism is provided.

As best seen in FIGS. 2 and 3, the height adjustment mechanism includes a block or bracket 180 having a transverse bore 182 therethrough which receives central member 152 of axle subassembly 150. Block 180 also includes a longitudinal, threaded bore 184 opening through its top end. An adjustment member in the form of an elongated shaft or rod 186 extends through an aperture 188 defined by a boss 189 formed in frame 12. Rod 186 is externally threaded and is threadably received within bore 184 of block 180. Secured to the upper end of rod 186 is an adjustment knob 190. Knob 190 is nonrotatably secured to rod 186 by a set screw 191. Rod 186 is rotatably mounted through an aperture 188. A spring means in the form of a coil spring 194 encircles rod 186. Spring 194 is positioned between a stop or nut 192 and a resilient or rubber washer or grommet 196 which engages the under surface of boss 189.

As should be readily apparent, rotation of knob 190 in a clockwise direction threads rod 186 into bore 184, thereby lowering frame 12 on the wheel and axle subassembly. The axle will rise vertically within guide slots 156. Rotation of knob 190 in a counterclockwise direction moves rod 186 out of bore 184, thereby shifting axle subassembly downwardly within the slots 156 and raising frame 12 with respect to the ground engaging wheels. Rubber washer 196 and spring 194 permit the adjustment assembly to absorb shock loading without damage. Aperture 188 and the dimensioning of adjustment rod 186 and block 180 are such that they do not restrict pivotal or rotating movement of frame 12 about its longitudinal axis due to operator input.

As best seen in FIGS. 1, 2 and 3, a pair of auxiliary support wheels 204, 206 are rotatably supported within suitable recesses defined at the rear of frame 12. Auxiliary wheels 204, 206 are thereby positioned in a horizontal plane spaced vertically above the horizontal plane of axle subassembly 150. When the control handle is latched in its upright, inoperative position, the machine may be tilted about axle subassembly 150 until auxiliary wheels 204, 206 engage the floor surface. This permits the machine to be placed in a storage position allowing access to floor treating element 34 and transport of the machine when it is not in use.

As seen in the drawings, a generally L-shaped wire bracket member 230 is secured to the main frame at aperture 231 adjacent auxiliary wheels 204, 206 by nuts 229. Wire bracket 230 defines generally horizontal, rearwardly extending portions 232, 234, vertical portions 233, 235 and a generally horizontal, transversely extending portion 236. Bracket 230 provides for convenient storage for the power cord.

In use, the power cord is wrapped around storage bracket horizontal portions 232, 234 and the upper handle grip 21. This is done when the handle is in a vertical or stored position. To remove the power cord, the operator releases handle 16 and pivots the handle to its operating position. The wound power cord will then move out from engagement with the cord storage bracket 230. The operator then removes the wound cord from the handle, places the power cord on the floor and unwinds it by pulling the end of the cord having the plug.

An alternative power cord storage bracket is illustrated in FIGS. 5 and 6 and generally designated 250. Bracket 250 is symmetrical about the longitudinal axis of the frame and includes generally upwardly extending portions 252 joined to outwardly extending portions 254. Portions 254 are joined to upward portions 256 which in turn are joined to rearward portions 258. Vertical portions 260 join a generally horizontal transverse portion 262 to portions 258. As seen in FIG. 6, bracket 250 has side portions outboard of the yoke legs of the control handle. The control handle may therefore pivot downwardly further before contacting bracket 250 than would be the case with bracket 230 installed. This is shown in phantom in FIG. 5. This permits the machine to be moved further under low tables, shelves and the like when compared to a machine having bracket 230. Bracket 250 is used in the same manner as bracket 230.

Also, it is presently preferred that brackets 230 and 250 include a protective rubber tube-like covering 270 at least along portions which would be contacted by the control handle. In the embodiment of FIGS. 5 and 6, covers 270 extend from the point of attachment of the bracket to the frame inboard of the handle yoke legs. Covers 270 protect walls, furniture and the like from contact with the bracket and therefore act as a bumper strip.

OPERATION

A high speed polisher in accordance with the preferred embodiment of the present invention polishes a floor surface by friction from the speed of the polishing pad. Motor 24, due to its positioning on frame 12 in relationship to the pivot points of control handle 16 and its relationship to ground engaging wheels 14, counterbalances the machine. This insures that proper pad weight on the floor is maintained at all times. This counterbalancing also insures that the pad is maintained parallel to the floor. The positioning of motor 24 allows the handle to move freely about its pivot points when unlatched without having an effect on the weight exerted on the pad or the positioning of the pad parallel to the floor surface.

The polishing pad or other vertical floor treating element is secured to the pad driver by fasteners 83. Once the pad is in position, an operator will pivot handle release lever 124 and move control handle 16 to an operating position. With the power cord plugged into a suitable electrical outlet, the operator will grasp handle switches 22 operating the on/off switch, thereby actuating drive motor 24. The switch opens and power to the drive motor is automatically cut off upon release of control levers 22. Due to the high starting torque of a high speed floor polisher, the machine should never be started when the handle is locked in a vertical position and the machine is tilted.

The machine is used by pushing it steadily forward on the floor. It should be moved slowly over high traffic areas and heavily soiled areas. For spotting or edging action, the pressure of the pad may be increased on the floor by tilting the machine to the right or to the left due to the unique suspension incorporated in the present invention.

In view of the foregoing, it should now be readily apparent to those of ordinary skill in the art that the unique vertical axis floor treating machine in accordance with the present invention increases ease of operation, permits ready substitution of different pads or brushes while insuring parallelism of the pad or brush during operation. Effective and simple control of brush aggressiveness is readily achieved due to the suspension means and the counterbalancing effect of the drive motor.

Those of ordinary skill in the art will undoubtedly envision various modifications to the present invention which would not depart from the inventive concepts disclosed herein. For example, threaded adjustment rod 186 could be replaced with a threaded bolt which would require a socket for adjustment. Also, a chain drive or gear belt drive could be substituted for the belt/pulley structure illustrated. The above description should, therefore, be considered as that of the preferred embodiment. The true spirit and scope of the present invention may be determined by reference to the appended claims.

The embodiments of the invention in which an exclusive property or privilege is claimed are defined as follows:

1. Apparatus for rotating a vertical axis floor treating element, said apparatus comprising:

a frame;

a pair of ground engaging wheels;

suspension means engaging said frame for suspending said frame on said ground engaging wheels comprising an axle extending transversely of said frame, said ground engaging wheels being rotatably mounted on said axle, said suspension means permitting said frame to pivot about a fore and aft longitudinal axis;

a pair of depending leg-like members carried by said frame, said leg-like members defining generally vertical slots within which said axle rides;

spring means extending downwardly from said frame and engaging said axle and said frame for suspending said frame and biasing said frame to a generally horizontal position with respect to said axle, and for permitting said frame to pivot about said fore and aft longitudinal axis while said wheels remain in contact with the floor to thereby permit edging by the floor treating element;

said suspension means further comprising vertical adjustment means carried by said frame and engaging said axle for raising and lowering said frame on said axle comprising a first member carried by said frame and rotatable with respect to said frame;

a second member threadably engaging said first member and secured to said axle whereby rotation of said first member shifts said second member to raise and lower said frame on said axle; and drive means on said frame for rotating the floor treating element.

2. Apparatus as defined by claim 1 wherein said adjustment means further includes:

resilient means interposed between said first member and said frame for absorbing shock loading to said adjustment means.

3. A high speed floor polisher of the type including a frame, a vertical axis rotary floor treating element rotatably mounted on the frame, a control handle pivoted to the frame and a pair of ground engaging wheels supporting the frame rearward of the vertical axis of the floor treating element, the improvement comprising;

a drive motor secured to the frame rearwardly of said ground engaging wheels;

means on said frame for pivoting said control handle to said frame forward of said motor whereby said motor counterbalances the weight of said floor treating element and said handle may pivot freely during operation of said machine; and suspension means engaging said frame for suspending said frame on said ground engaging wheels and for permitting said frame to pivot about a longitudinal axis while said wheels remain in contact with the floor to thereby permit edging by the floor treating element.

4. A high speed floor polisher as defined by claim 3 wherein said suspension means comprises:

an axle extending transversely of said frame, said ground engaging wheels being rotatably mounted on said axle;

spring means extending downwardly from said frame and engaging said axle and said frame for suspending said frame and biasing said frame to a generally horizontal position with respect to said axle yet permitting said frame to pivot about a longitudinal axis of said frame.

5. A high speed floor polisher as defined by claim 4 further including:

vertical adjustment means carried by said frame and engaging said axle for raising and lowering said frame on said axle.

6. A high speed floor polisher of the type including a frame, a vertical axis floor treating element rotatably mounted on the frame, a control handle pivoted to the frame and a pair of ground engaging wheels supporting the frame, the improvement comprising:

a drive motor secured to the frame rearwardly of said ground engaging wheels and said floor treating element, said floor treating element secured to said frame forward of said ground engaging wheels, said drive motor nearly counterbalancing the remaining weight of said floor polisher;

a suspension means comprising:

an axle extending transversely of said frame, said ground engaging wheels being rotatably mounted on said axle;

vertical adjustment means carried by said frame and engaging said axle for raising and lowering said frame on said axle comprising:

a first member carried by said frame and rotatable with respect to said frame, and a second member threadably engaging said first member and secured to said axle whereby rotation of said first member shifts said second member to raise and lower said frame on said axle;

spring means extending downwardly from said frame and engaging said axle and said frame for suspending said frame and biasing said frame to a generally horizontal position with respect to said axle yet permitting said frame to pivot about a longitudinal axis of said frame; and a means on said frame for pivoting said control handle to said frame forward of said motor whereby said motor counterbalances the weight of other portions of said floor polisher and said handle may pivot freely during operation of said floor polisher.

7. A high speed floor polisher as defined by claim 6 wherein said adjustment means further includes:

resilient means interposed between said first member and said frame for absorbing shock loading to said adjustment means.

8. A high speed floor polisher comprising:

a frame;

means carried by said frame for defining a pair of opposed, transversely spaced vertical guide slots;

an axle extending between and disposed within said guide slots;

a pair of ground engaging wheels rotatably mounted on said axle;

vertical adjustment means carried by said frame and engaging said axle for raising and lowering said axle within said guide slots, said vertical adjustment means including resilient means for absorbing shock loading of said axle, said vertical adjustment means including a member having a transverse bore through which said axle extends, said member further defining a threaded bore;

an elongated, threaded rod threadably received within said threaded bore at one end extending through an aperture in said frame at the other end;

a stop carried by said rod;

said resilient means comprising a resilient member around said rod and engaging an undersurface of said frame and a spring on said rod and positioned between and engaging said resilient member and said stop;

a floor treating element;

mounting means for rotatably mounting said floor treating element to said frame forward of said axle; drive means on said frame for rotating said floor treating element; and a control handle pivoted to said frame generally above said ground engaging wheels.

9. A high speed floor polisher as defined by claim 8 wherein said vertical adjustment means further includes a knob fixed to said other end of said rod.

10. A high speed floor polisher as defined by claim 8 further including frame suspension means engaging said axle for resiliently suspending said frame on said axle and for permitting said frame to be pivoted about a longitudinal axis upon application of pressure to the control handle whereby said floor treating element may be edged.

11. A high speed floor polisher as defined by claim 10 wherein said drive means includes a motor secured to said frame rearwardly of said axle and the point where said control handle pivots to said frame so that said motor counterbalances the weight of said floor treating element.

12. A high speed floor polisher as defined by claim 11 further including a generally L-shaped bracket secured to said frame rearwardly of said motor for storing a power cord by wrapping the cord about the bracket and the control handle.

13. A high speed floor treating machine, comprising:

a main frame having a longitudinal axis, a front end and a rear end, said frame including a pair of transversely opposed, generally vertical slots;

an axle extending transversely of said main frame and riding within said slots;

a pair of ground engaging wheels supported on said axle;

frame suspension means engaging said axle for suspending said frame on said axle and permitting said frame to rotate about its longitudinal axis, said frame suspension means including spring means carried by said frame and engaging said axle for biasing said frame to a generally parallel position with respect to a horizontal plane passing through said axle, adjustment means engaging said axle for raising and lowering said axle within said slots;

a control handle pivoted to said frame and movable from a stored position to an operative position;

a floor treating element rotatably mounted on said frame forward of said axle; and drive means on said frame and operatively connected to said floor treating element for rotating said floor treating element whereby pressure on said control handle rotates said frame and said floor treating element about the longitudinal axis of said frame to permit edging with the floor treating element.

14. A high speed floor treating machine as defined by claim 13 wherein said adjustment means comprises:

an elongated rod having one end secured to said axle and another end extending upwardly from said axle; and an adjustment knob secured to said elongated rod at said another end for shifting said rod towards and away from said frame to thereby move said axle within said slots to raise and lower said frame on said axle.

15. A high speed floor treating machine as defined by claim 14 further including:

latch means on said handle and engageable with said frame for latching said handle to said frame when said handle is in its stored position.

16. A high speed floor treating machine as defined by claim 15 wherein said control handle is pivoted to said frame generally above said axle and said drive means includes a motor secured to said frame rearwardly of said axle thereby to counterbalance the weight of said floor treating element about said axle.

* * * * *